US007130560B2

(12) United States Patent
Kawai et al.

(10) Patent No.: US 7,130,560 B2
(45) Date of Patent: Oct. 31, 2006

(54) IMAGE FORMING APPARATUS

(75) Inventors: Toshiharu Kawai, Mishima (JP); Hideki Kotsuka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/063,642

(22) Filed: Feb. 24, 2005

(65) Prior Publication Data

US 2005/0191086 A1 Sep. 1, 2005

(30) Foreign Application Priority Data

Feb. 27, 2004 (JP) ..... 2004-054332
Feb. 2, 2005 (JP) ..... 2005-026529

(51) Int. Cl.
*G03G 15/00* (2006.01)
*G03G 21/00* (2006.01)
*G03G 21/16* (2006.01)

(52) U.S. Cl. ..... 399/110; 399/124; 399/125

(58) Field of Classification Search ..... 399/110, 399/114, 125, 124
See application file for complete search history.

(56) References Cited

U.S. PATENT DOCUMENTS 5,208,612 A 5/1993 Obu et al. ..... 346/153.1
5,438,391 A 8/1995 Maekawa et al. ..... 355/200
5,444,515 A 8/1995 Haneda et al. ..... 355/200
5,887,228 A * 3/1999 Motohashi et al. ..... 399/111
5,903,803 A 5/1999 Kawai et al. ..... 399/116
6,055,406 A 4/2000 Kawai et al. ..... 399/360
6,115,567 A 9/2000 Kawai et al. ..... 399/106
6,128,454 A 10/2000 Kawai et al. ..... 399/116
6,163,665 A 12/2000 Watanabe et al. ..... 399/111
6,175,706 B1 1/2001 Watanabe et al. ..... 399/167
6,226,478 B1 5/2001 Watanabe et al. ..... 399/117
6,240,266 B1 5/2001 Watanabe et al. ..... 399/117
6,336,018 B1 1/2002 Kawai et al. ..... 399/117
6,349,188 B1 2/2002 Kawai et al. ..... 399/116
6,381,430 B1 4/2002 Yokomori et al. ..... 399/119
6,463,232 B1 10/2002 Kawai et al. ..... 399/111
6,480,687 B1 11/2002 Kawai et al. ..... 399/111
6,496,667 B1 12/2002 Shiratori et al. ..... 399/103
6,501,926 B1 12/2002 Watanabe et al. ..... 399/117
6,501,927 B1 12/2002 Watanabe et al. ..... 399/117
6,560,422 B1 5/2003 Kanno et al. ..... 399/106
6,735,403 B1 5/2004 Kanno et al. ..... 399/103
6,738,588 B1 5/2004 Yokomori et al. ..... 399/111
6,798,430 B1 9/2004 Sato ..... 347/115
6,947,686 B1 9/2005 Kawai et al. ..... 399/111
6,978,103 B1 12/2005 Miura et al. ..... 399/116
2001/0055499 A1 12/2001 Sato ..... 399/111
2003/0142994 A1 7/2003 Harada et al. ..... 399/111

(Continued)

FOREIGN PATENT DOCUMENTS

EP 0 346 934 A2 12/1989

(Continued)

*Primary Examiner*—David M. Gray
*Assistant Examiner*—Joseph S. Wong
(74) *Attorney, Agent, or Firm*—Fitzpatrick, Cella Harper & Scinto

(57) ABSTRACT

The image forming apparatus includes an opening and closing device that can be opened or closed with respect to a main body of an image forming apparatus, a plurality of image forming devices, a recording material containing device which contains a recording material and which can be detachably mounted on the main body, and a positioning device which positions the opening and closing device in an open state. By this arrangement, the ability to detach the image forming devices is improved without increasing the dimensions of the apparatus.

9 Claims, 8 Drawing Sheets

U.S. PATENT DOCUMENTS

| | | | | |
|---|---|---|---|---|
| 2003/0156848 | A1* | 8/2003 | Kawai et al. | 399/27 |
| 2003/0156856 | A1 | 8/2003 | Arimitsu et al. | 399/114 |
| 2004/0005169 | A1 | 1/2004 | Yokomori et al. | 399/117 |
| 2005/0002688 | A1* | 1/2005 | Jeong et al. | 399/110 |
| 2005/0047821 | A1* | 3/2005 | Murayama et al. | 399/111 |
| 2005/0185984 | A1 | 8/2005 | Arimitsu et al. | 399/114 |

FOREIGN PATENT DOCUMENTS

| | | | |
|---|---|---|---|
| EP | 1 331 525 | A2 | 7/2003 |
| EP | 1 387 226 | A1 | 2/2004 |
| JP | 06-110262 | A | 4/1994 |
| JP | 6-250450 | A | 9/1994 |
| JP | 6-273985 | A | 9/1994 |
| JP | 08-022157 | A | 1/1996 |
| JP | 08-115042 | A | 5/1996 |
| JP | 08-254862 | A | 10/1996 |
| JP | 2001-356550 | A | 12/2001 |
| JP | 2003-233278 | A | 8/2003 |

* cited by examiner

IMAGE FORMING APPARATUS

CROSS-REFERENCE TO RELATED APPLICATIONS

This application claims priority from Japanese Patent Application Nos. 2004-054332 filed on Feb. 27, 2004 and 2005-026529 filed on Feb. 2, 2005, which are hereby incorporated by reference herein.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates to an image forming apparatus utilizing an electrophotographic process or an electrostatic recording process such as a copying apparatus, a printer or a facsimile apparatus, and more particularly an image forming apparatus provided with an opening and closing device which is opened or closed with respect to a main body of the apparatus.

2. Description of Related Art

A prior image forming apparatus particularly utilizing an electrophotographic process is often provided with a process cartridge integrally including a photosensitive member serving as an image bearing member and image forming device, such as a developing apparatus for interaction therewith, or a unit containing consumables to be replaced or replenished by a user, such as a transfer material container (sheet cassette) containing a transfer material such as a paper sheet for image formation. Also various proposals have been made for improving the operability of the replacement of the process cartridge or of the paper replenishment for the sheet cassette.

For example, Japanese Patent Application Laid-open No. H8-115042 discloses a structure in which attach-detach apertures for a unit for an image bearing member and a cassette for a recording medium are positioned on a same side of the main body of the image forming apparatus and have the same attach-detach direction.

Such a conventional structure, however, is a lateral-opening type of apparatus in which a front cover is opened about a vertical axis (hinge) and the front cover is merely supported at the hinge side, so that it is difficult to maintain the same positional precision of the front cover, to the main body of the apparatus, at left and at right (hinged side and opposite side).

Particularly in case an image forming device is mounted on the front cover, the positional precision becomes different at the left and the right sides of the image forming apparatus, thus hindering a satisfactory image formation operation.

Thus, Japanese Patent Application Laid-open No. H6-110262 discloses an apparatus in which a front cover is opened downwards about a horizontal axis (vertical-opening type) for the replacement of a process unit. Such an apparatus allows the maintenance of the same positional precision at the left and the right of the front cover.

It is described that, in such apparatus, a sheet cassette can be mounted and detached from the front side of the apparatus, but a device which determines an open position of the front cover is not described, and the replacement of the process unit is made possible but the replacement of the sheet cassette may be hindered depending upon the open position of the front cover.

Also Japanese Patent Application Laid-open Nos. H8-22157 and 2001-356550 describe an apparatus of the vertical-opening type, but does not describe a device which positions the open/closing member (cover) by determining a certain open position for the open/closing member (cover).

In a full-color image forming apparatus, there are provided with a plurality of process cartridges each having a photosensitive member for respective colors, and an improvement in the maintenance property because of an increased frequency of replacements. Also the presence of plural process cartridges tends to increase the dimension of the apparatus, and there is desired an apparatus capable of suppressing an increase in the dimension thereof even with an improved maintenance property.

BRIEF SUMMARY OF THE INVENTION

An object of the present invention is to provide an image forming apparatus capable of improving operability of a detachable image forming device without increasing the dimension of the apparatus.

Another object of the present invention is to provide an image forming apparatus including an opening and closing device that can be opened or closed with respect to a main body of the apparatus, a plurality of image forming devices which are rendered mountable on or detachable from the main body of the apparatus, a recording material containing device which contains a recording material and which can be detachably mounted on the main body, and a positioning device which positions the opening and closing device in an open state. Attaching or detaching of the plurality of image forming devices and attaching or detaching of the recording material containing device are executed on the same side of the main body of the apparatus. The attaching or detaching direction of the plurality of image forming devices is different from the attaching or detaching direction of the recording material containing device, and the positioning device positions the opening and closing device in a space defined between an attaching or detaching trajectory of the plurality of image forming devices and an attaching or detaching trajectory of the recording material containing device.

Still other objects of the present invention will become fully apparent from the following detailed description.

DETAILED DESCRIPTION OF THE INVENTION

In the following, an embodiment of the present invention will be explained with reference to the accompanying drawings.

Figure 1:
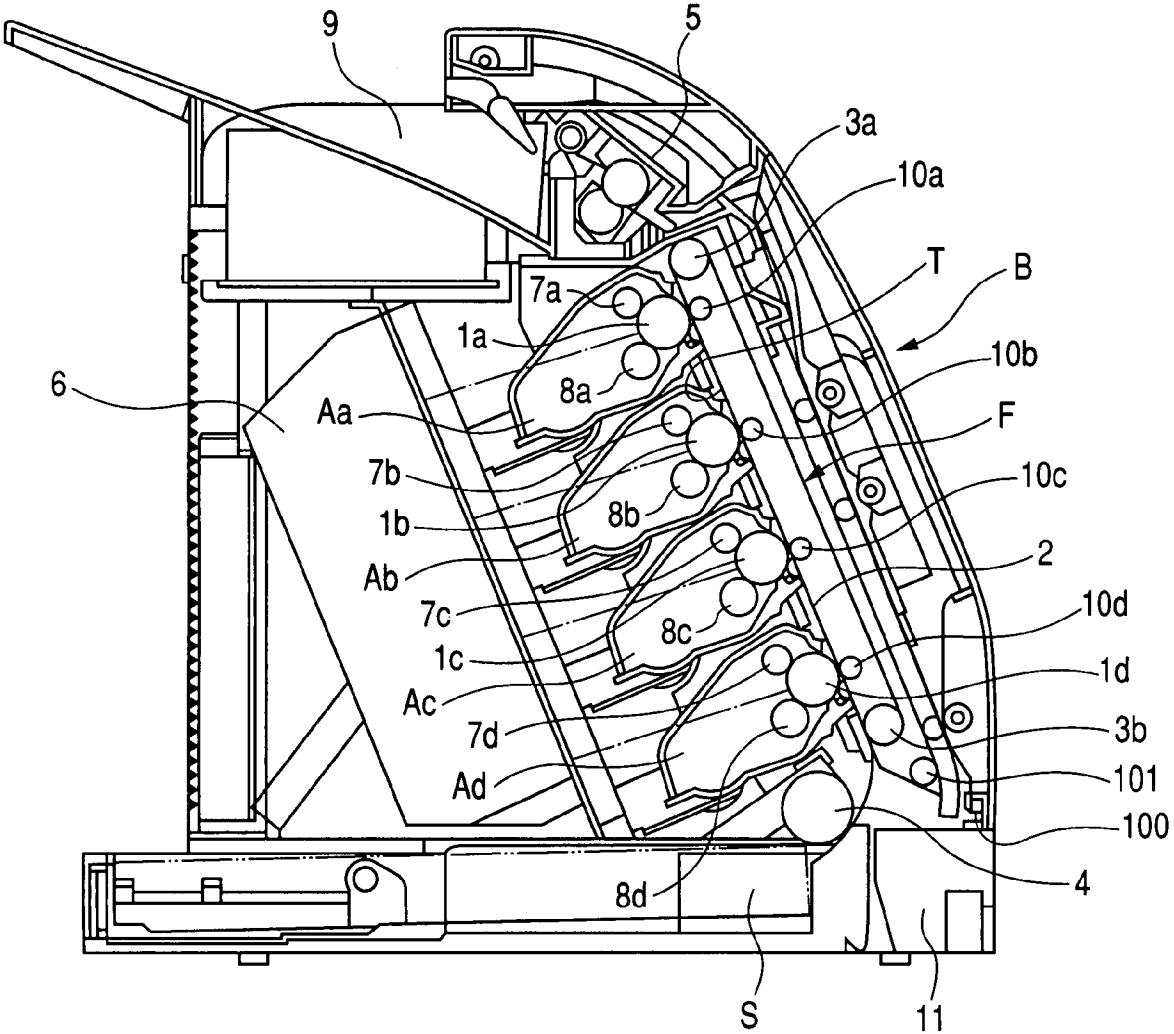
FIG. 1 is a view showing an image forming apparatus embodying the present invention.

FIG. 1 is a vertical cross-sectional view of an electrophotographic image forming apparatus serving as a four-color full-color printer and constituting an example of the image forming apparatus embodying the present invention.

Now an image forming operation of this image forming apparatus will be explained with reference to FIG. 1.

The image forming apparatus is provided, respectively for black, cyan, magenta and yellow colors, with a plurality of image forming devices (process cartridges) Aa, Ab, Ac and Ad. Each process cartridge integrally includes a drum-shaped electrophotographic photosensitive member (photosensitive drum) 1*a*, 1*b*, 1*c* or 1*d* constituting an image bearing member, and at least an image forming member acting on the photosensitive drum. Each of the process cartridges Aa–Ad is individually detachably mountable on a main body of the image forming apparatus.

The process cartridges Aa–Ad are respectively provided, in addition to the photosensitive drums, with charging rollers 7*a*, 7*b*, 7*c*, 7*d* and developing rollers 8*a*, 8*b*, 8*c*, 8*d* as image forming members.

In the process cartridges Aa–Ad, surfaces of the photosensitive drums 1*a*–1*d* are uniformly charged, in a charging step, by the charging rollers 7*a*–7*d*, and, in an exposure step or a latent image forming step, are exposed to light in an area where an image is to be formed, by an exposure apparatus 6 such as a laser, thereby forming electrostatic latent images on the photosensitive drums 1*a*–1*d*. Then, the electrostatic latent images on the photosensitive drums 1*a*–1*d* are developed by deposition of developers (toners) of respective colors by the developing rollers 8*a*–8*d*, whereby developer images of the respective colors are formed on the photosensitive drums 1*a*–1*d*.

On the other hand, in synchronization with the image formation on the process cartridges Aa–Ad, a recording material (transfer material) S such as paper, contained in a sheet cassette 1 constituting the recording material containing device, is fed, by a feed device, such as a sheet feeding roller 4, onto a conveyor belt 2 constituting a conveying member. The conveyor belt 2 is opposed to the process cartridges Aa–Ad, more specifically to the photosensitive drums 1*a*–1*d*, and is driven by a driving roller 3*a* whereby the recording material supported on the conveyor belt 2 is conveyed to such photosensitive drums 1*a*–1*d*.

The conveyor belt 2 is supported under a tension between the driving roller 3*a* and an idler roller 3*b*, and, along a belt surface T thus formed, the process cartridges Aa–Ad are arranged in an array with the photosensitive drums 1*a*–1*d* positioned at the side of the belt T.

Opposed areas of the photosensitive drums 1*a*–1*d* and the belt surface T constitute transfer portions, and transfer rollers 10*a*, 10*b*, 10*c*, 10*d* constituting transfer members are positioned in such transport portions and at a side opposite to the side of the belt surface T opposed to the photosensitive drums 1*a*–1*d*.

The toner images formed in the process cartridges Aa–Ad are transferred, in a transfer step, from the photosensitive drums 1*a*–1*d* onto the recording material under a bias voltage application to the transfer rollers 10*a*–10*d*, and, the recording material bearing the unfixed toner image is subjected, in a fixing step, to fixation of the image by heat and pressure in a fixing device 5, is then discharged to a sheet discharge portion 9 and stacked.

Then, with reference to FIGS. 1 and 2, there will be explained art attaching/detaching operation for the process cartridges Aa–Ad of the present embodiment. A door B, constituting an opening and closing device which can be opened and closed with respect to the main body of the apparatus, is opened and closed for replacing the process cartridges or for addressing a jam. In the present embodiment, the door B is provided on a front surface (a side surface spreading in the substantially vertical direction) of the main body of the apparatus, and is opened and closed by a rotary motion about a support member 100 as a shaft provided along an axis in a substantially horizontal direction in a lower part. Thus, the opening and closing of the door B at least involves a displacement in the vertical direction, and the door B is thus rendered displaceable about the shaft 100 provided in the substantially horizontal direction, and is opened from above to below.

Also the conveyor belt 2, the rollers 3*a*, 3*b* and the transfer rollers 10*a*–10*d* are constructed as a unit of transfer-conveying device F, which is rendered capable of a rotary motion about a support member (shaft) 101 and is connected in an upper part with a link to the door B, whereby the transfer-conveying device F can be simultaneously opened by opening the door B. Stated differently, the transfer-conveying device F is supported by the door B. In the open state, the belt surface T of the conveyor belt 2 is positioned upward.

In the aforementioned image forming apparatus, the process cartridges Aa–Ad and the sheet cassette 11 are constructed as consumable-containing units which are rendered mountable on and detachable from the main body of the apparatus. The sheet cassette 11 is mounted and detached for example for replenishing or replacing the paper sheets. Access positions to the door B and to the process cartridges Aa–Ad and the sheet cassette 11 are all provided in the front side of the apparatus, and the access to such door B and to such process cartridges Aa–Ad and sheet cassette 11 can be made from a same direction.

Figure 2:
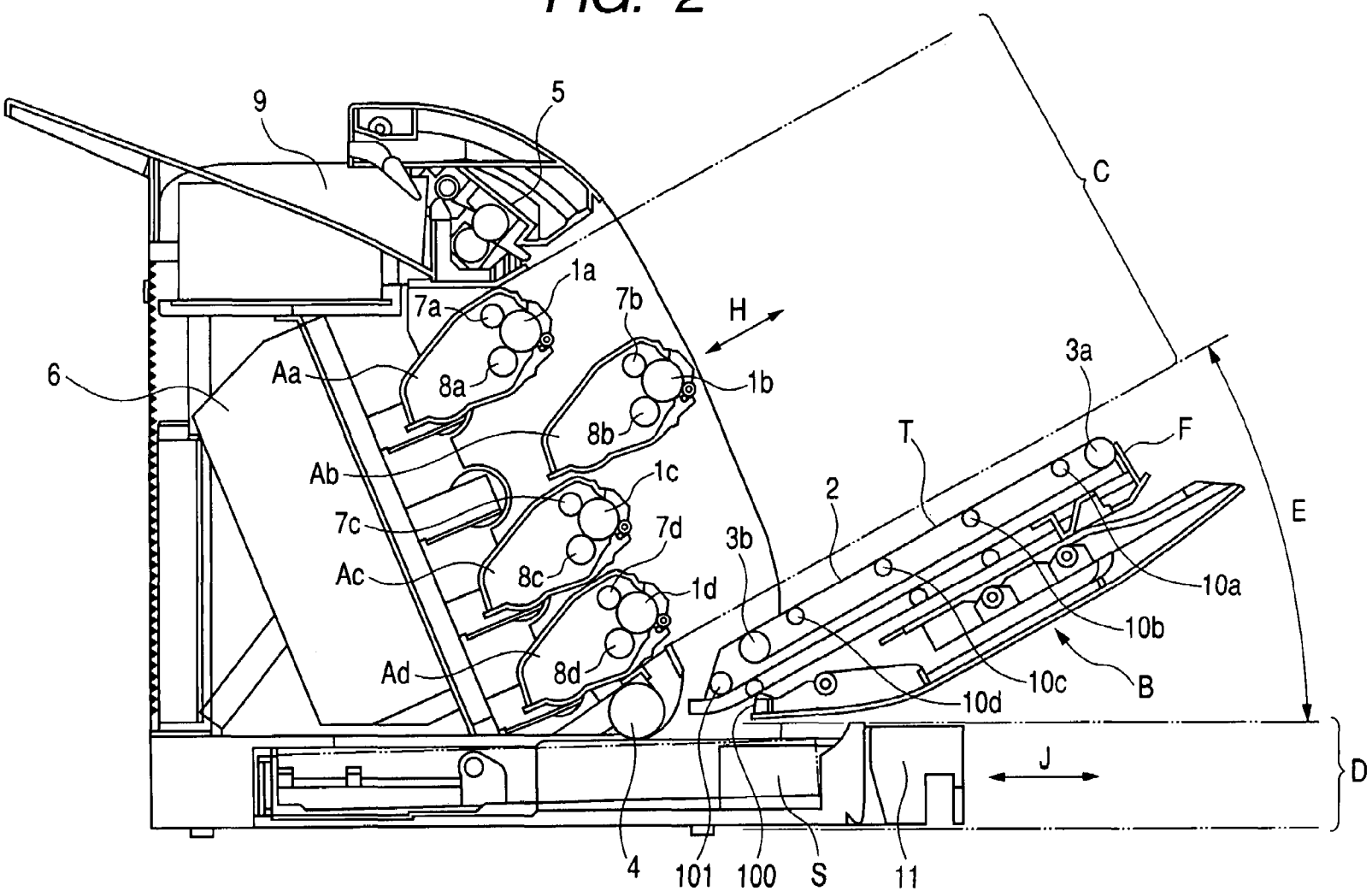
FIG. 2 is a view showing an open door state.

FIG. 2 shows an attach/detach operation (an attaching or detaching operation), for example, for replacing the process cartridges Aa–Ad and an attach/detach operation (an attaching or detaching operation) for the sheet cassette 11, for example, for sheet replenishment. By opening the door B supporting the conveyor belt 2, the driving roller 3*a* and the idler roller 3*b*, and the process cartridges Aa–Ad can be accessed and can be detached or mounted.

As shown in FIG. 2, the process cartridges Aa–Ad are extracted in an obliquely upward direction (direction H), while the sheet cassette 11 is extracted in a substantially horizontal direction (direction J). Thus, the surface of the main body of the image forming apparatus for mounting or detaching the process cartridges Aa–Ad and the surface of the main body of the image forming apparatus for mounting or detaching the sheet cassette 11 are positioned in a same side of the main body of the image forming apparatus, whereby the attach/detach operation for the process cartridges Aa-Ad and the attach/detach operation for the sheet cassette 11 are executed at a same side of the main body of the image forming apparatus.

However, the attach/detach direction (an attaching or detaching direction) for the process cartridges Aa–Ad is different from the attach/detach direction (an attaching or detaching direction) for the sheet cassette 11.

In the present embodiment, as shown in FIG. 1, the belt surface T is provided along a vertically inclined direction, namely in a direction inclined from a vertical direction. The belt surface T is inclined along a direction in which the belt surface T is shifted, from below to above, toward the process cartridges. Therefore, the process cartridges Aa-Ad are arranged obliquely, with the photosensitive drums 1*a*–1*d* directed upwards. Thus, the plural process cartridges Aa–Ad are inclined from the vertical direction, and an upper positioned cartridge (for example Ac) among the plural process cartridges Aa–Ad is further away from the side of the door B than a lower positioned cartridge (for example Ad). In this manner, the upper positioned cartridge (for example Ac) is positioned, with respect to the lower positioned cartridge (for example Ad), opposite to the door B.

Figure 3:
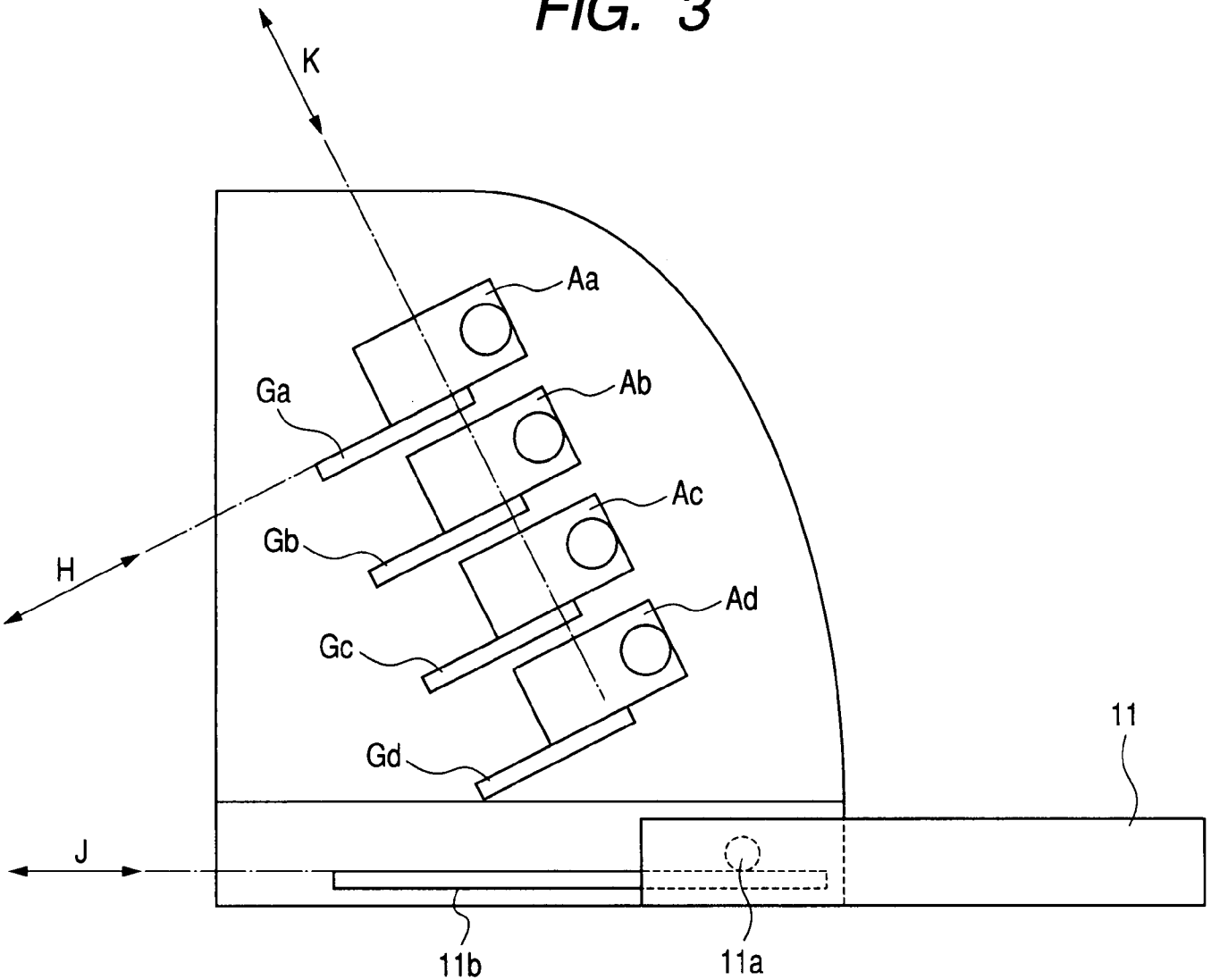
FIG. 3 is a view showing an attaching/detaching guide for a cartridge and a cassette.

FIG. 3 schematically shows a guide used in attaching or detaching the process cartridges and the sheet cassette 11. Cartridge guide members Ga, Gb, Gc and Gd are provided for respectively guiding the process cartridges Aa–Ad, which can be attached to or detached from the main body of the apparatus by moving the process cartridges Aa–Ad along a direction H. There are shown an engaging protrusion 11*a* provided on the sheet cassette 11 and a cassette guide member 11*b* which engages h the engaging protrusion 11*a*, thereby guiding the displacement of the sheet cassette 11, which can be attached to or detached from the main body of the apparatus by moving the sheet cassette 11 along a direction J. The attach/detach operation of the sheet cassette 11 is executed in a lower part of the door B, with a substantially horizontal attach/detach direction J. Thus, the attach/detach direction H for the process cartridges Aa–Ad is different from the attach/detach direction J for the sheet cassette 11.

A direction K in which the process cartridges Aa–Ad are arrayed is substantially perpendicular, in the present embodiment, to the attach/detach direction of the process cartridges Aa–Ad.

Thus, in the present embodiment, the attach/detach direction of the process cartridges Aa–Ad is rendered oblique to the attach/detach direction of the sheet cassette 11, thereby securing an area C (called the attach/detach trajectory (attaching or detaching trajectory) of process cartridges) as shown in FIG. 2, defined by trajectories of the process cartridges Aa–Ad during the attach/detach operation thereof. Thus, there is secured the area C as an area in which the process cartridges Aa–Ad are rendered movable, parallel to an extension of the attach/detach direction of the process cartridges Aa–Ad, extending in an obliquely upward direction from the door B and the sheet cassette 11. Also there is secured an area D (called the attach/detach trajectory (attaching or detaching trajectory) of cassette 11) constituting a lower and horizontal trajectory for the attach/detach operation of the sheet cassette 11. Thus, there is secured the area D as an area in which the sheet cassette 11 is rendered movable, parallel to an extension of the attach/detach direction of the sheet cassette 11. Also, in an opened state of the door B, the door B is positioned and fixed in a position in an area E defined between the areas C and D.

In the present embodiment, therefore, it is rendered possible to attach or detach the process cartridges Aa–Ad and the sheet cassette 11 at the same time while reducing the entire height of the apparatus, thereby improving operability.

Also in the present embodiment, as the process cartridges Aa–Ad are inclined not only in the attach/detach direction thereof but also in the direction of arrangement thereof, even a process cartridge positioned in the lower part of the array can be attached or detached without interfering with the process cartridges in the upper part of the array, whereby the process cartridges are not restricted in shape.

Figure 4:
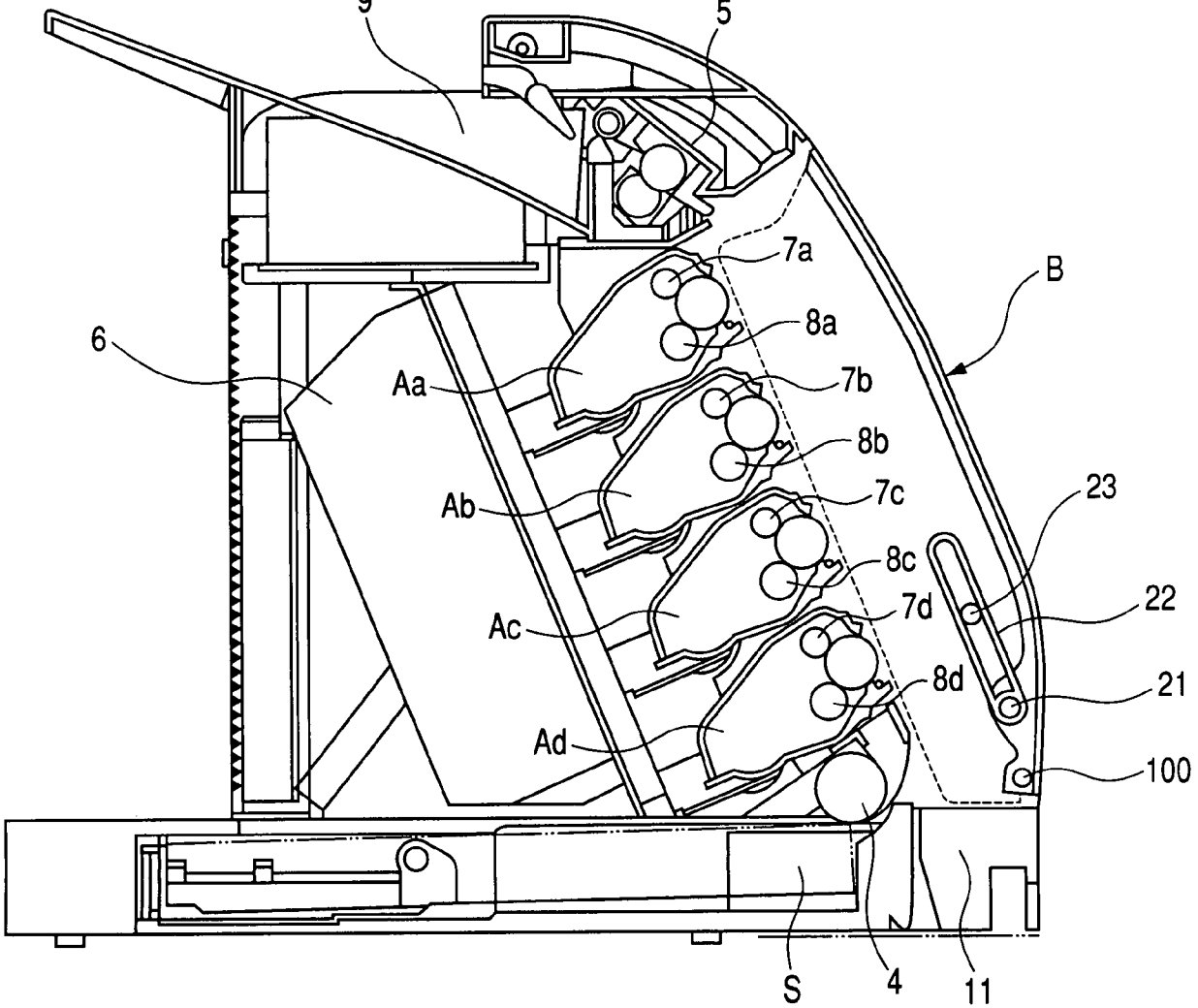
FIG. 4 is a view showing a door positioning device in a closed door state.
Figure 5:
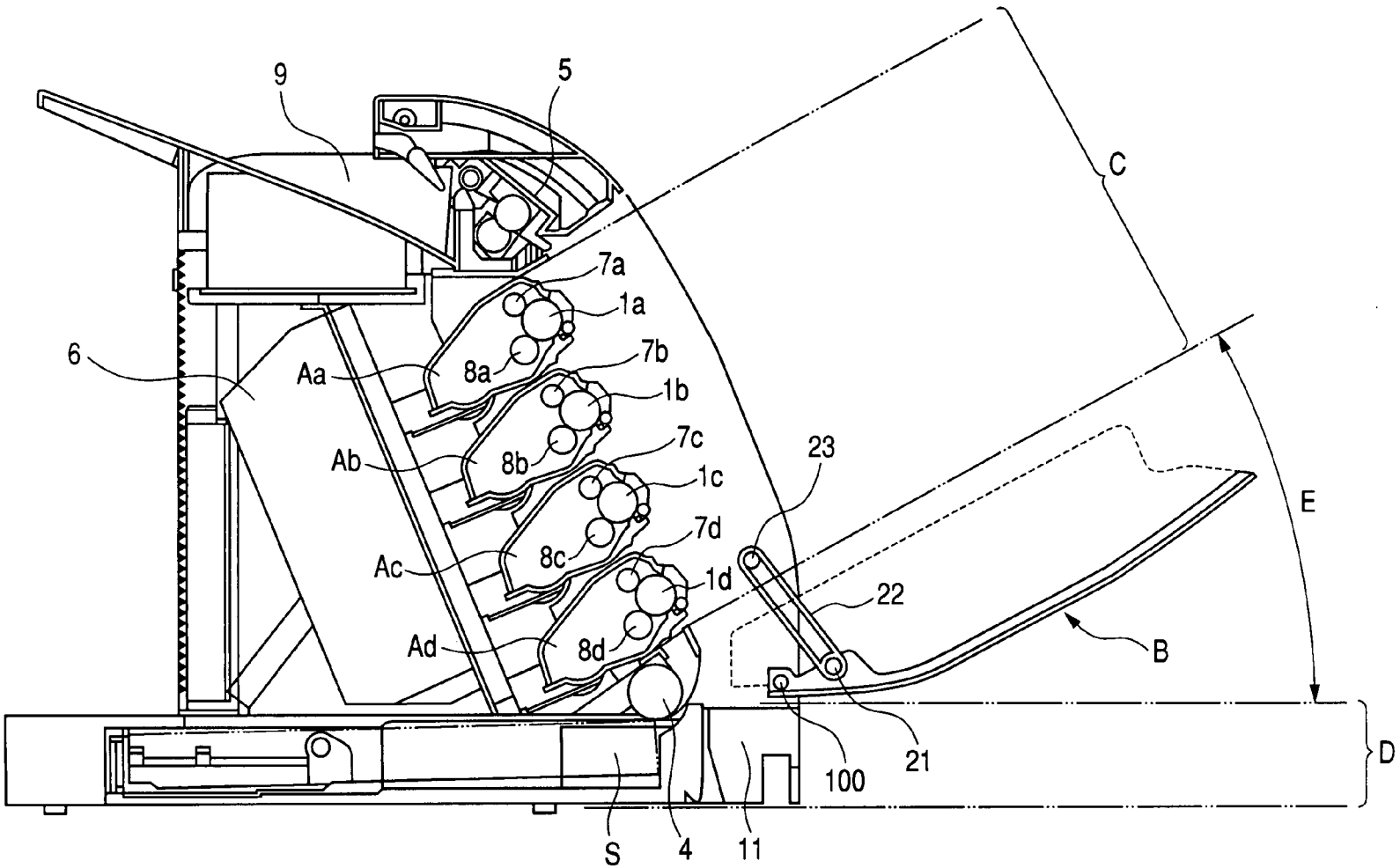
FIG. 5 is a view showing a state where the door in an open state is positioned.

FIGS. 4 and 5 illustrate a positioning device for positioning the door B when it is opened.

There are shown a rotary shaft (protruding portion) 21 provided on the door B, an engaging protrusion 23 provided on the main body of the apparatus, and an engaging member 22 rendered rotatable about the rotary shaft 21 and having an elongated hole in which the engaging protrusion 23 can engage. Such rotary shaft 21, engaging protrusion 23 and engaging member 22 constitute the positioning device for the opened state of the door B.

When the door B is opened from a state shown in FIG. 4 to a state shown in FIG. 5, the rotary shaft 21 is displaced with a displacement of the engaging member 22, and, when an end of the elongated hole of the engaging member 22 comes into contact with the engaging protrusion 23 thereby inhibiting the displacement of the engaging member 22, the door B is fixed and positioned in such position.

Figure 6:
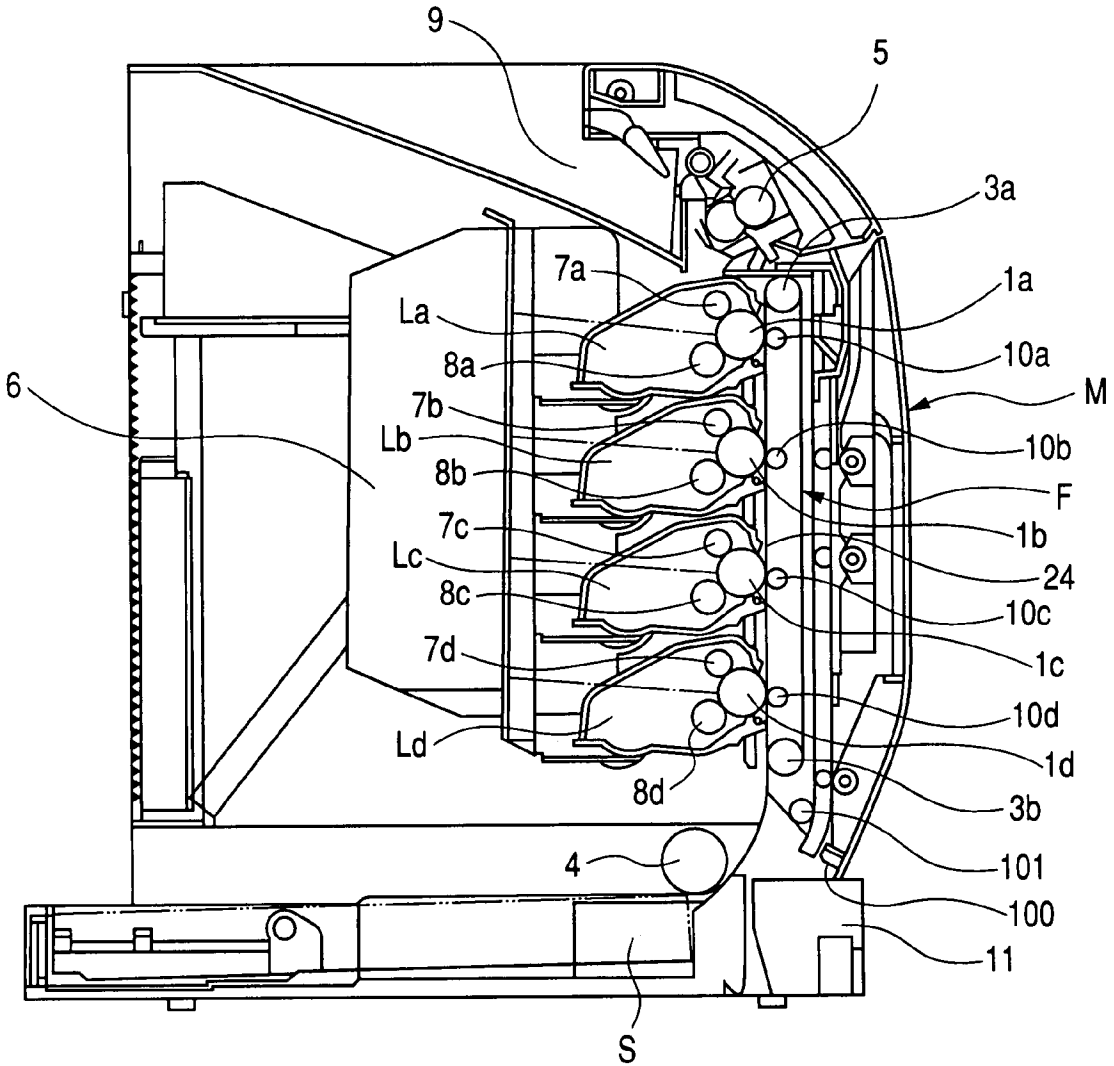
FIG. 6 is view showing an image forming apparatus of a comparative example.
Figure 7:
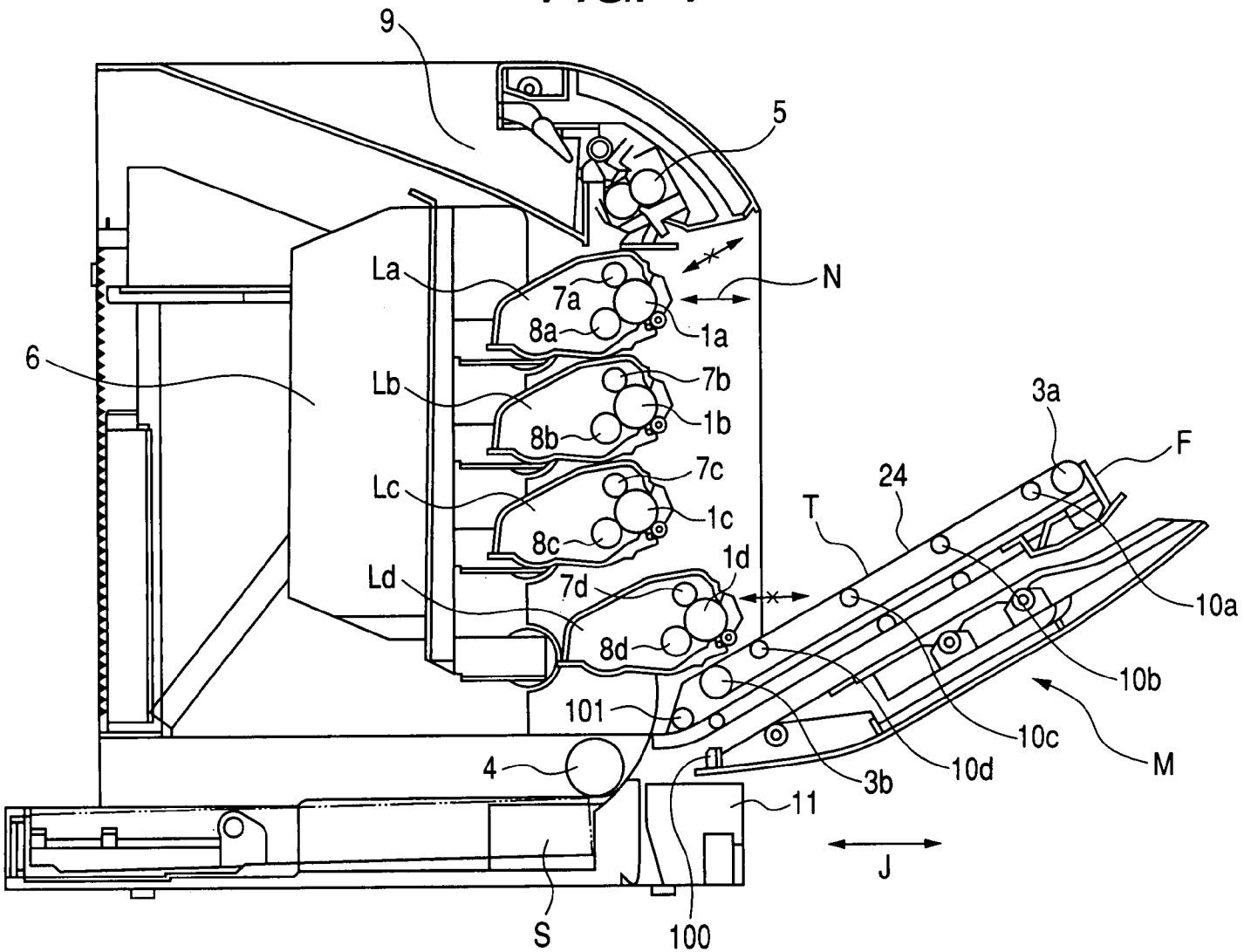
FIG. 7 is a view showing a door positioning device in an open door state.

Now an image forming apparatus shown in FIGS. 6 and 7 will be explained as a comparative example. The image forming apparatus shown in FIG. 6 has the same components as those in the embodiment of the invention shown in FIG. 1, but a sheet conveying path constituted by the photosensitive drums 1*a*–1*d* and a conveyor belt 24 in cartridges La, Lb, Lc and Ld are not inclined obliquely but are provided in the vertical direction.

In this comparative example, the uppermost cartridge La cannot be attached or detached in an inclined direction because of the presence of a fixing device 5 thereabove. In order to avoid such drawback, the attach/detach direction of the cartridges La–Ld has to be selected in a horizontal direction N. If the opening angle of a door M is defined, in a similar manner as in FIG. 2, so as to enable the attach/detach operation of a sheet cassette 11 in the horizontal direction J, the lowermost cartridge Ld comes into contact with the door M and cannot therefore be attached or detached. In order to enable an attach/detach operation of the cartridge Ld, the door M has to be rotated by at least 90° until the belt 24 becomes horizontal, and then the sheet cassette 11 cannot be attached or detached.

In the comparative example, therefore, it is not possible to execute the attach/detach operation of the cartridges La–Ld and the attach/detach operation of the sheet cassette at the same time in a state where the door M is fixed in a certain open position.

Also in order to enable the attach/detach operation of the sheet cassette 11 even when the door M is opened until the belt 24 becomes horizontal, it is conceivable to increase the gap between the sheet cassette 11 and the cartridge Ld or to increase the gap between the cartridge La and the fixing device 5, thereby enabling the attach/detach operation in an oblique direction, but such methods inevitably increase the height of the image forming apparatus, thereby resulting in an undesirably bulky structure thereof.

Thus, in the present embodiment, the attach/detach direction of the process cartridge Aa–Ad is inclined with respect to the attach/detach direction of the sheet cassette 11, to form an attach/detach trajectory in the area C shown in FIG. 2, while a space is defined as the area E between the area C and the area D constituting an attach/detach trajectory of the sheet cassette 11, and the door B in an open state is provided in such space. It is thus rendered possible to attach/detach the process cartridges Aa–Ad and the sheet cassette 11 at the same time, thereby improving operability. The operability can be further improved as the open/close operation of the door, the attach/detach operation of the process cartridges and the attach/detach operation of the sheet cassette can all be executed in the same direction with respect to the main body of the apparatus.

Furthermore, the apparatus can be made further compact by providing the sheet conveying path in an inclined position.

In the present embodiment, the statement "the process cartridges and the sheet cassette can be attached or detached at the same time" in the embodiment implies that both the process cartridges and the sheet cassette can be accessed without further moving the door in the open state.

In the present embodiment, the sheet cassette is attached or detached in the horizontal direction, but such configuration is not restrictive.

Also the present embodiment is constructed as a full-color printer utilizing four process cartridges, but a monochromatic printer utilizing one process cartridge only can also be constructed, and a similar effect can also be obtained by constructing the conveyor belt with a conveying roller or the like.

Figure 8:
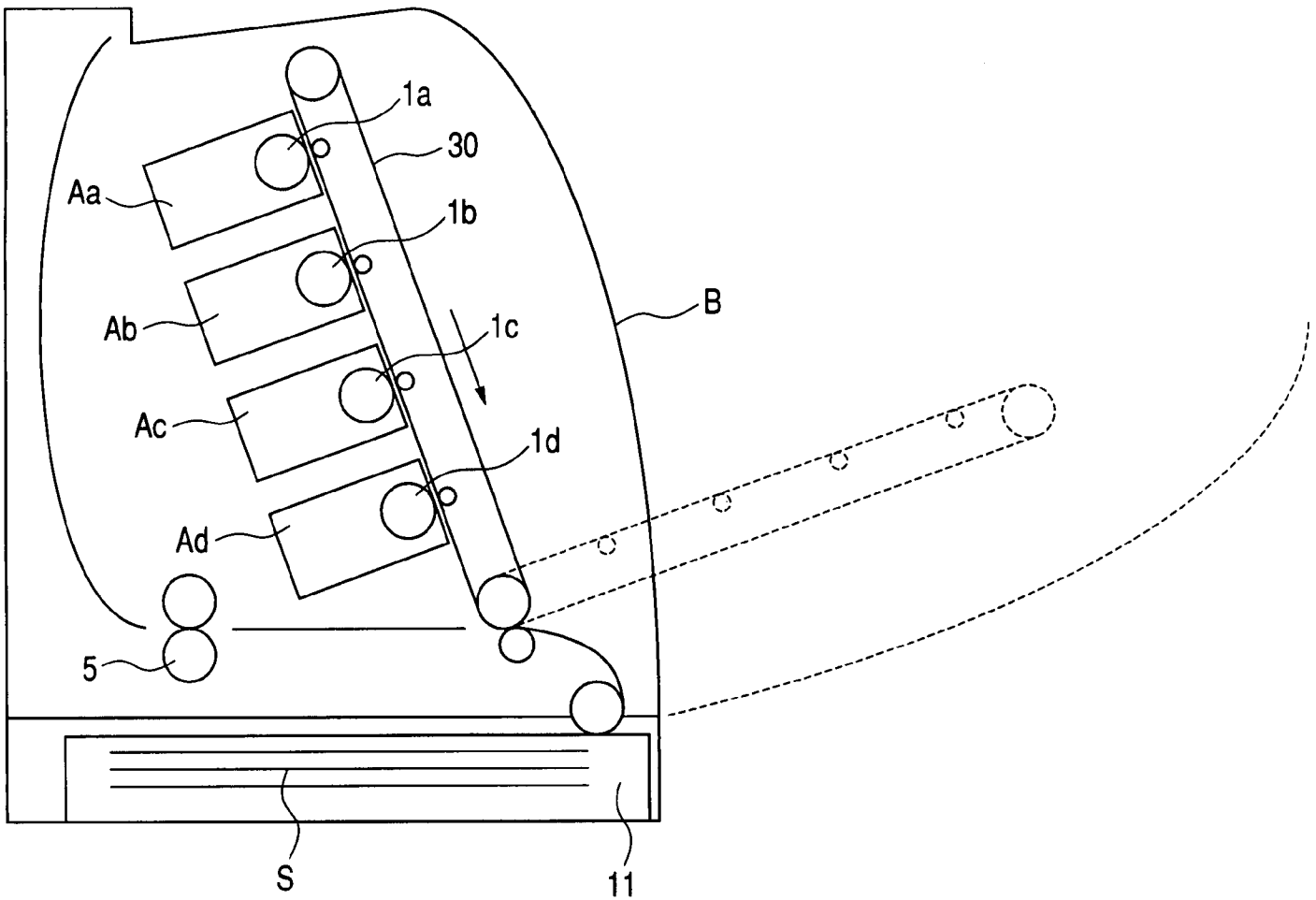
FIG. 8 is a view showing another image forming apparatus to which the invention is applicable.

Also in the present embodiment, the conveying member moving in opposition to the photosensitive drum is constituted of a conveyor belt for conveying a recording material, but it may also be constituted of an intermediate transfer member (intermediate transfer belt) for bearing and carrying a toner image. Thus, the present invention is applicable also to an image forming apparatus of an intermediate transfer type as shown in FIG. 8, in which a toner image is transferred from an image bearing member 1 onto an intermediate transfer member 30 whereby plural toner images are once borne on the intermediate transfer member and then collectively transferred onto a recording material S.

As to the components of the aforementioned image forming apparatus, the dimension, the material, the shape, the relative position and the like are not to be construed to limit the invention to such description, unless a particularly specifying description is provided.

The present invention has been explained by an embodiment, but the invention is not at all limited to such embodiment and is subject to any and all modifications within the technical concept of the invention.

What is claimed is:

1. An image forming apparatus comprising:

an opening and closing device that is capable of being opened or closed with respect to a main body of the image forming apparatus;

a support member which pivotably supports said opening and closing device;

a plurality of image forming devices capable of being detachably mounted on the main body in a state where said opening and closing device is opened;

a recording material containing device which contains a recording material and which is capable of being detachably mounted on the main body, wherein said plurality of image forming devices are provided above said recording material containing device, wherein a surface of the main body for attaching or detaching said recording material containing device is the same as a surface of the main body for attaching or detaching said plurality of image forming devices, wherein a detaching direction of said plurality of image forming devices is inclined upwards, while a detaching direction of said recording material containing device is substantially horizontal; and a positioning device configured to position said opening and closing device by regulating movement of said opening and closing device when said opening and closing device is opened around said support member, wherein said positioning device positions said opening and closing device in a space defined between the inclined-upward detaching direction of said plurality of image forming devices and the substantially horizontal detaching direction of said recording material containing device.

2. An image forming apparatus according to claim 1, wherein said support member is a shaft and said opening and closing device is movable about said shaft provided in a substantially horizontal direction.

3. An image forming apparatus according to claim 2, wherein said opening and closing device is opened from above to below.

4. An image forming apparatus according to claim 1, wherein each of said plurality of image forming devices is a cartridge integrally including a photosensitive member and at least an image forming member acting on said photosensitive member, and a plurality of said cartridges correspond respectively to different colors.

5. An image forming apparatus according to claim 1, further comprising a conveying member opposed to said plurality of image forming devices, wherein said conveying member moves in linkage with an opening or closing operation of said opening and closing device.

6. An image forming apparatus according to claim 5, wherein said conveying member is a belt.

7. An image forming apparatus according to claim 1, wherein the direction of arrangement of said plurality of image forming devices is inclined from the vertical direction, and an image forming device positioned above another image forming device is spaced further from said opening and closing device than said another image forming device.

8. An image forming apparatus according to claim 7, wherein the direction of arrangement of said plurality of image forming devices is substantially perpendicular to an attaching or detaching direction of said plurality of image forming devices.

9. An image forming apparatus according to claim 1, wherein one of said plurality of image forming devices is provided above another of said plurality of image forming devices.

* * * * *

UNITED STATES PATENT AND TRADEMARK OFFICE

CERTIFICATE OF CORRECTION

PATENT NO. : 7,130,560 B2
APPLICATION NO. : 11/063642
DATED : October 31, 2006
INVENTOR(S) : Toshiharu Kawai et al.

It is certified that error appears in the above-identified patent and that said Letters Patent is hereby corrected as shown below:

COLUMN 4:
Line 14, "art" should read -- an --.

COLUMN 5:
Line 32, "h" should be deleted.

Signed and Sealed this

Twenty-ninth Day of July, 2008

JON W. DUDAS
*Director of the United States Patent and Trademark Office*